US006100813A

United States Patent [19]

Yamaguti et al.

[11] Patent Number: 6,100,813

[45] Date of Patent: Aug. 8, 2000

[54] PAGER WITH DISPLAY POSITION CONTROLLED

[75] Inventors: Tetsuya Yamaguti; Takayuki Komori; Atsushi Katagiri, all of Yokohama, Japan

[73] Assignee: Matsushita Electric Industrial Co., Ltd., Japan

[21] Appl. No.: 08/966,352

[22] Filed: Nov. 7, 1997

[30] Foreign Application Priority Data

Nov. 13, 1996 [JP] Japan ..... 8-301503

[51] Int. Cl.[7] ..... G08B 5/22

[52] U.S. Cl. ..... 340/825.44; 455/38.1; 455/38.2; 455/38.3; 379/57

[58] Field of Search ..... 340/825.44, 825.48, 340/825.69, 875.72, 825.8, 825.26, 825.05; 379/57; 455/38.1, 38.3, 38.2

[56] References Cited

U.S. PATENT DOCUMENTS 5,359,317 10/1994 Gomez et al. ..... 340/825.44
5,784,001 7/1998 DeLuca et al. ..... 340/825.44

FOREIGN PATENT DOCUMENTS 64-48946 3/1989 Japan .
6-12887 2/1994 Japan .

*Primary Examiner*—Michael Horabik
*Assistant Examiner*—Anthony A. Asongwed
*Attorney, Agent, or Firm*—Parkhurst & Wendell, L.L.P.

[57] ABSTRACT

A pager includes a receiving circuit for receiving a transmitted paging signal including a calling signal and a message which includes character codes; a display having a predetermined character display area; a first storing circuit for storing the message when the calling signal indicates this pager; a setting circuit responsive to a manual operation for setting position data indicative of a position of one of the character codes in the message; a second storing circuit for storing the position data in response to the setting circuit; and a displaying circuit for reading a portion of the message including the portion of character codes from the storing circuit in accordance with the position data from the second storing circuit and displaying the portion of character codes on the display. In addition to storing the position data, a target subject data may be stored to search the position of a message to be displayed.

3 Claims, 5 Drawing Sheets

FIG. 6A

FIRST SCREEN IMAGE

| | |
|---|---|
| AAA | 000 |
| AAB | 111 |
| AAC | 222 |
| AAD | 333 |

FIG. 6B $M^{TH}$ SCREEN IMAGE

| | |
|---|---|
| EEE | 999 |
| FFF | 888 |
| GGG | 777 |
| HHH | 666 |

FIG. 6C

OPERATE CURSOR SW ON $M^{TH}$ SCREEN IMAGE

| | | |
|---|---|---|
| EEE | 999 | |
| FFF | 888 | ← 26 |
| GGG | 777 | |
| HHH | 666 | |

FIG. 6D $M'^{TH}$ SCREEN IMAGE

| | | |
|---|---|---|
| FFF | 888 | ← |
| GGG | 777 | |
| HHH | 666 | |
| III | 555 | |

FIG. 6E

SCREEN IMAGE AFTER CHANGE

| | | |
|---|---|---|
| AAA | 987 | ← |
| AAB | 123 | |
| AAC | 654 | |
| AAD | 000 | |

PAGER WITH DISPLAY POSITION CONTROLLED

BACKGROUND OF THE INVENTION

1. Field of the Invention

This invention relates to a pager for receiving a transmitted paging signal including a message.

2. Description of the Prior Art

A pager for receiving a transmitted paging signal including a calling signal and a message and displaying the message directing this pager is known. Moreover, another prior art pager, having a plurality of channels, for receiving a plurality of kinds of broadcasted messages every channel and display the broadcasted message such as weather forecast. In this prior art pager, the display area is limited, so that scrolling is necessary to see the weather forecast at the desired location.

SUMMARY OF THE INVENTION

The aim of the present invention is to provide an improved pager.

According to the present invention, a first pager is provided, which comprises: a receiving circuit for receiving a transmitted paging signal including a calling signal and a message which includes character codes; a display having a predetermined character display area; a first storing circuit for storing the message when the calling signal indicates this pager; a setting circuit responsive to a manual operation for setting position data indicative of a position of one of the character codes in the message; a second storing circuit for storing the position data in response to the setting circuit; and a displaying circuit for reading a portion of the message including the portion of character codes from the first storing circuit in accordance with the position data from the second storing circuit and displaying the portion of character codes on the display.

In the first pager, the second storing circuit stores the position data even if the receiving circuit receives the next transmitted paging signal and the calling signal included in the next transmitted paging signal indicates this pager. In this case, the first pager may further comprise: a judging circuit for judging whether the next message included in the next transmitted paging signal can be displayed on the display using the position data; and a position data changing circuit for changing the position data when the judging circuit judges that the next message cannot be displayed on the display using the position data.

According to the present invention, a second pager is provided, which comprises: a receiving circuit for receiving a transmitted paging signal including a calling signal and a message including a plurality of sectors, each sector including subject data and current data regarding the subject data; a display for displaying the message every sector; a first storing circuit responsive to the receiving circuit for storing the message when the calling signal indicates this pager; a setting circuit responsive to a manual operation for setting address data of the first storing circuit indicative of one of the sectors; a second storing circuit responsive to the setting circuit for storing the address data; and a displaying circuit for reading a portion of the message including at least the one of the sectors in accordance with the address data and displaying the read portion on the display.

According to the present invention, a third pager is provided, which comprises: a receiving circuit for receiving a transmitted paging signal including a calling signal and a message including a plurality of sectors, each sector including subject data and current data regarding the subject data; a display for displaying the message every sector; a first storing circuit responsive to the receiving circuit for storing the message when the calling signal indicates this pager; a second storing circuit responsive to a manual operation for storing the subject data included in one of the sectors; a collating circuit for collating the subject data in the second storing circuit with the subject data of each sector included the next message when the receiving circuit receives the next transmitted paging signal and the calling signal indicates this pager; and a displaying circuit for reading and displaying a portion of the next message including at least one of the sectors in accordance with a collating result from the collating circuit. In this case, the displaying circuit reads and displays the portion of the next message such that the portion of the next message includes the subject data corresponding the subject data in the second storing circuit. Moreover, in that case, a displaying portion changing circuit for changing the portion of the next message to be displayed when the collating circuit cannot detect collation of the subject data in the second storing circuit with the subject data of each sector included the next message when the receiving circuit receives the next transmitted paging signal and the calling signal indicates this pager may be further provided.

BRIEF DESCRIPTION OF THE DRAWINGS

The object and features of the present invention will become more readily apparent from the following detailed description taken in conjunction with the accompanying drawings in which:

FIGS. 6A to 6E are illustrations of the first embodiment showing another example.

The same or corresponding elements or parts are designated with like references throughout the drawings.

DETAILED DESCRIPTION OF THE INVENTION

Hereinbelow will be described a first embodiment of this invention.

Figure 1:
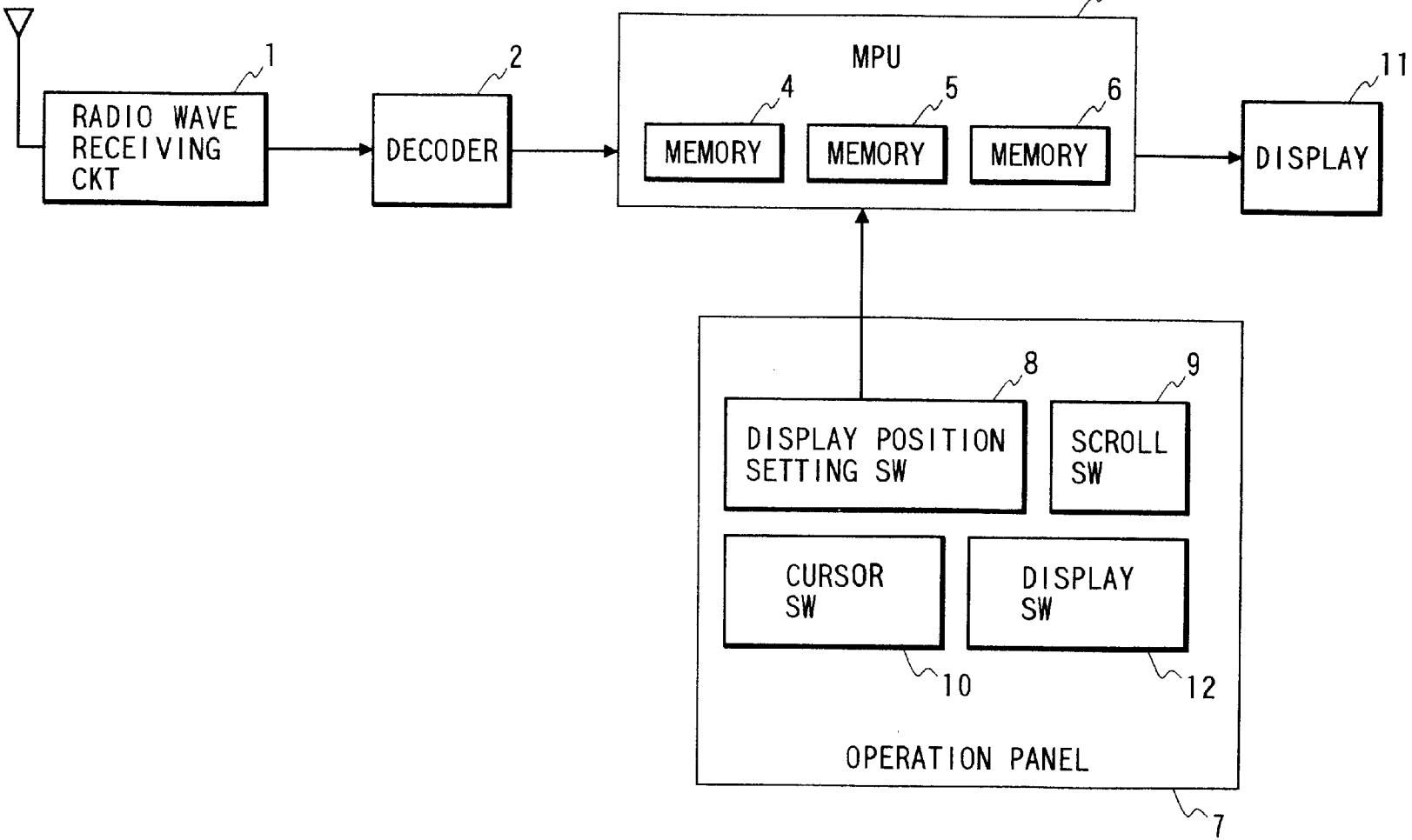
FIG. 1 is a block diagram of a pager according to embodiments of this invention.

FIG. 1 is a block diagram of a pager according to embodiments of this invention.

The pager of the first embodiment comprises a radio wave receiving circuit 1 including an antenna for receiving a transmitted paging signal including a calling signal and a message following the calling signal, a decoder 2 for decoding the received paging signal, a display 11, an operation panel 7, a microprocessor 3 including first to third memories 4 to 6 for storing and displaying the message on the display 11, and effecting necessary operations in response to the operation panel 7.

The first memory 4 stores identification codes. The first identification code is provided for the first channel assigned to the personal message directing this pager. Other identification codes are provided for receiving various broadcasting information, such as weather forecast, through every channel defined by the identification code.

The operation panel 7 includes a display position setting switch 8, a scroll switch 9, a cursor switch 10, a display switch 12, and other operation switches. The second memory 5 stores the received message when the paging signal is directed to this pager, that is either of the identification codes corresponds to the identification code in the calling signal.

The second memory 5 stores messages at every storing area defined by the channel, i.e., the identification codes assigned to this pager. The third memory 6 stores initial position data IPD which is position data for initially displaying the message, that is, for initially displaying the message in response to the display switch 12 and scroll position data SPD.

The radio wave receiving circuit 1 receives the transmitted paging signal including the calling signal and the message following the calling signal. The decoder 2 decodes the paging signal. The microprocessor 3 stores the received message when the paging signal is directed to this pager, that is, either of the identification codes corresponds to the identification code in the calling signal.

The microprocessor 3 increases scroll position data SPD by one in response to a scroll switch 9 on the operation panel 7 to scroll a portion of the message to be displayed because the display 11 has a predetermined display area, for example, one line including ten chinese characters or twenty alphabets. The microprocessor 3 stores the scroll position data SPD in the third memory 6 as the initial position data IPD when an operator depresses the display position setting switch 8. The microprocessor 3 responds to a cursor switch 10 and generates a cursor on the display 11. The microprocessor 3 displays a portion of the message in accordance with the initial position data IPD after the display position setting switch 8 is operated.

Figure 2A:
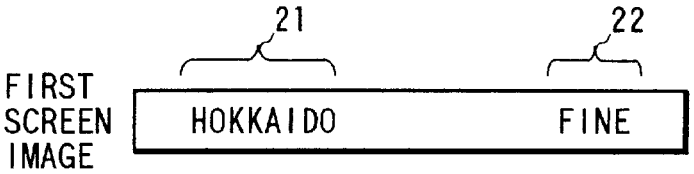
FIGS. 2A to 2C are illustrations of the first embodiment showing a first example of operation.
Figure 2B:
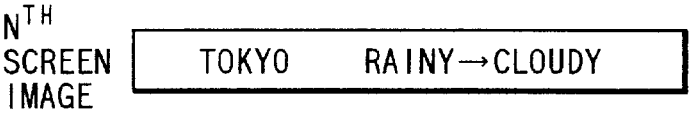
Figure 2C:
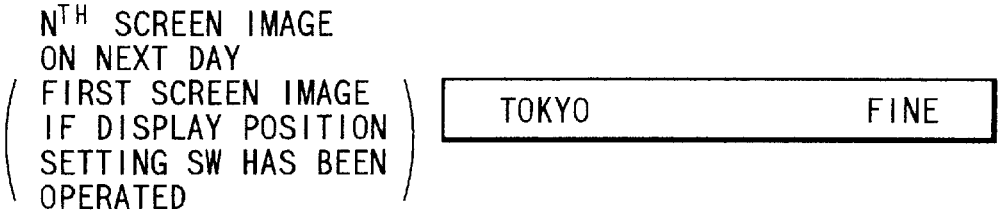

FIGS. 2A to 2C are illustrations of the first embodiment showing a first example of operation.

In the first example, the display 11 has the display area of one row capable of displaying ten chinese characters at once as shown in FIGS. 2A to 2C and the screen image is, in response to the scroll switch 9, scrolled every line, that is, every sector of the message, wherein each sector includes character codes and one return code. The return codes may be included in the message or generated every pager in accordance with various sizes of the display areas. Therefore, the scroll position data SPD is generated every line displayed. However, it is also possible that the position data is generated every character in the message. The scroll position data SPD indicates the number of lines from the beginning of the message, which corresponds to address data of the second memory 5.

When the operator desires to watch a weather forecast which is one of the broadcasted messages, the operator operates the display switch 12. Then, the microprocessor 3 displays the first portion of the message, i.e., the first sector, on the display 11 as shown in FIG. 2A. For example, the first portion of the message represents "HOKKAIDO" as the subject data 21 and "FINE" as the current data 22 regarding the subject data 21. The message includes a plurality of sectors. Every sector includes the subject data 21 and the current data regarding the subject data 22. In this example, the weather forecasts of every local area of Japan arranged in the order from the north area, that is, from Hokkaido. The Nth screen image shows the weather forecast of Tokyo area which is rainy and then, cloudy. The Nth image on the next day will be renewed, namely, "TOKYO FINE" as shown in FIG. 2C.

When the operator operates the display switch 12 to display the weather forecast before operating the display position setting switch 8, the microprocessor 3 displays the first screen image, that is, the weather forecast in Hokkaido as shown in FIG. 2A. If the operator desires the weather forecast in Tokyo, the operator depresses the scroll switch 9 (N−1) times. Then, the microprocessor 3 displays the Nth screen image on the display 11 as shown in FIG. 2B. The weather forecast is renewed every predetermined interval. If the operator do not use the display position stetting switch 8, the operator should operate the scroll switch 9 (N−1) times again on the next day. However, if the operator depresses the display position setting switch 8 while the Nth screen image is displayed on the display 11, the operator can watch the weather forecast of TOKYO as the first screen image without operating the scroll switch 9 on the next day.

Figure 3:
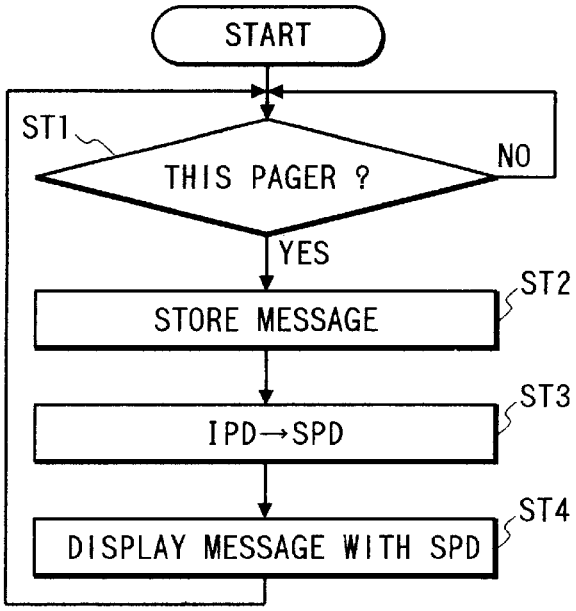
FIGS. 3 to 5 depict flow charts of the first embodiment showing operations of the microprocessor shown in FIG. 1.
Figure 4:
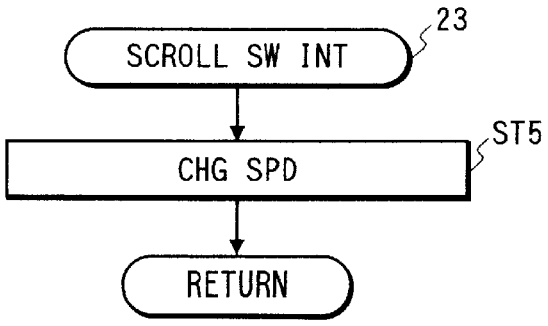
Figure 5:
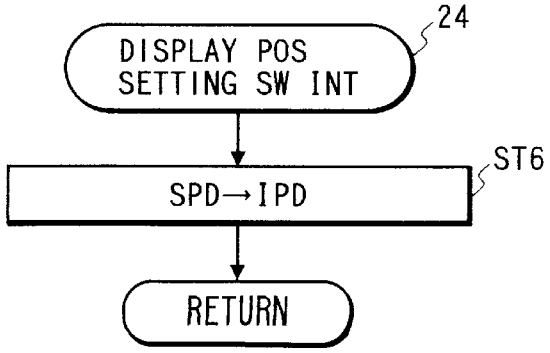

FIGS. 3 to 5 depict flow charts of the first embodiment showing operations of the microprocessor 3.

In step st1, the microprocessor 3 decides whether the paging signal is directed to this pager when the transmitted paging signal arrives. If the paging signal is directed this pager, the microprocessor 3 stores the message in the second memory 5 in accordance with the channel defined by the identification code in the paging signal in step st2. In the following step st3, the microprocessor 3 substitutes the scroll position data SPD with the initial position data IPD, that is, the initial position data IPD is stored as the scroll position data SPD. Then, the microprocessor 3 displays the message with the scroll position data SPD, that is, a portion of the message is displayed on the display 11 in accordance with the scroll position data SPD in step st4. More specifically, the microprocessor 3 generates the address data of the second memory 5 to display the portion of the message (the forecast of TOKYO) on the display 11. Then, the processing returns to step st1.

FIG. 4 shows a scroll switch interruption.

When the operator depresses the scroll switch 9 during displaying the message in step st4, the microprocessor 3 responds to this and executes the scrolling switch interruption 23. In response to the scrolling switch 8, the microprocessor 3 changes the scroll position data SPD in step st5, that is, increases the scroll position data SPD by one. When scrolling reaches the end of the message, the value the scroll position data SPD returns to the top position of the message.

FIG. 5 shows a display position setting switch interruption 24. In response to operation of the display position setting switch 8 during the processing of step st4, the microprocessor 3 executes the display position setting switch interruption 24. In step st6, the microprocessor 3 substitutes the initial position data IPD with the scroll position data SPD, that is, the microprocessor stores the scroll position data SPD as the initial position data IPD in the third memory 6.

According to the above-mentioned operation by the microprocessor 3, the pager displays the message at the top of the message in response to the display switch 12 if the display position setting switch 8 has been not used. Then, the operator operates the scroll switch 9, the microprocessor 3 scrolls, that is, the portion of the message to be displayed is renewed every depression of the scroll switch 9. If the operator searched the desired information, the operator depresses the displaying position setting switch 8. Then, the initial position data IPD for immediately displaying the desired portion of message is stored. After this, when the operator depresses the display switch 12, the microprocessor 3 displays the portion of the message using the initial position data IPD. Therefore, the desired portion of the message, that is, the weather forecast of Tokyo area is displayed without scrolling even on the next day as shown in FIG. 2C.

In this embodiment, the scroll position data is changed every line, that is, every sector. However, it is also possible that the scroll position data is changed every character in the message and further, it is also possible that the scroll position data is changed every pages, that is, a plurality of sectors which corresponds to the number of rows of the display 11.

FIGS. 6A to 6E are illustrations of the first embodiment showing another example.

In this example, stock prices are transmitted and displayed on a display 11' having a display area of four rows. It is assumed that the desired stock price is FFF and is displayed on the Mth screen image from the first screen image. At first, the stock prices AAA, AAB, AAC, and AAD are displayed on the first screen image as shown in FIG. 6A. Then, the desired stock price FFF is displayed after scrolling (M/4−1) times as shown in FIG. 6B. In this condition, if the operator depresses the display position setting switch 8, the scroll position data SPD is stored in the third memory 6 as the initial position data IPD. Accordingly, the operator can see the desired stock price FFF immediately at the next time as mentioned above.

Moreover, in this example, the screen image can be sightly shifted to display the desired stock price FFF at the top of the screen image. That is, the operator operates the cursor switch 10 to display the cursor 26 on the Mth screen image as shown in FIG. 6C. Then, the operator depresses the display position setting switch 8 while the Mth screen image is displayed. This stores the scroll position data SPD is stored in the third memory 6 as the initial position data IPD and an offset value (=1) is also stored in the third memory 6. When the operator operates the operation switch 12 after this operation, the microprocessor 3 displays the M'th screen image immediately without scrolling operation as shown in FIG. 6D, wherein the screen image is shifted by one row from the screen image in FIG. 6C.

If at the next display operation, the stock price FFF cannot be received, or the transmitted message includes sectors of which the number is inconsistent with the initial position data IPD, that is, it is less than the number of sectors corresponding to the initial position data IPD, the microprocessor 3 judges that the initial position data IPD cannot be maintained. Then, the microprocessor 3 changes the initial position data IPD, that is, it initializes the initial position data IPD, that is, stores zero as the initial position data IPD when the microprocessor 3 receives such a message. Therefore, when the operator operates the display switch 12, the microprocessor 3 displays the first screen image as shown in FIG. 6E.

A second embodiment will be described.

The pager of the second embodiment has substantially the same structure as the first embodiment. The difference is that a target subject data 21 for searching is stored in the third memory 6 in addition to the initial position data IPD.

Figure 7:
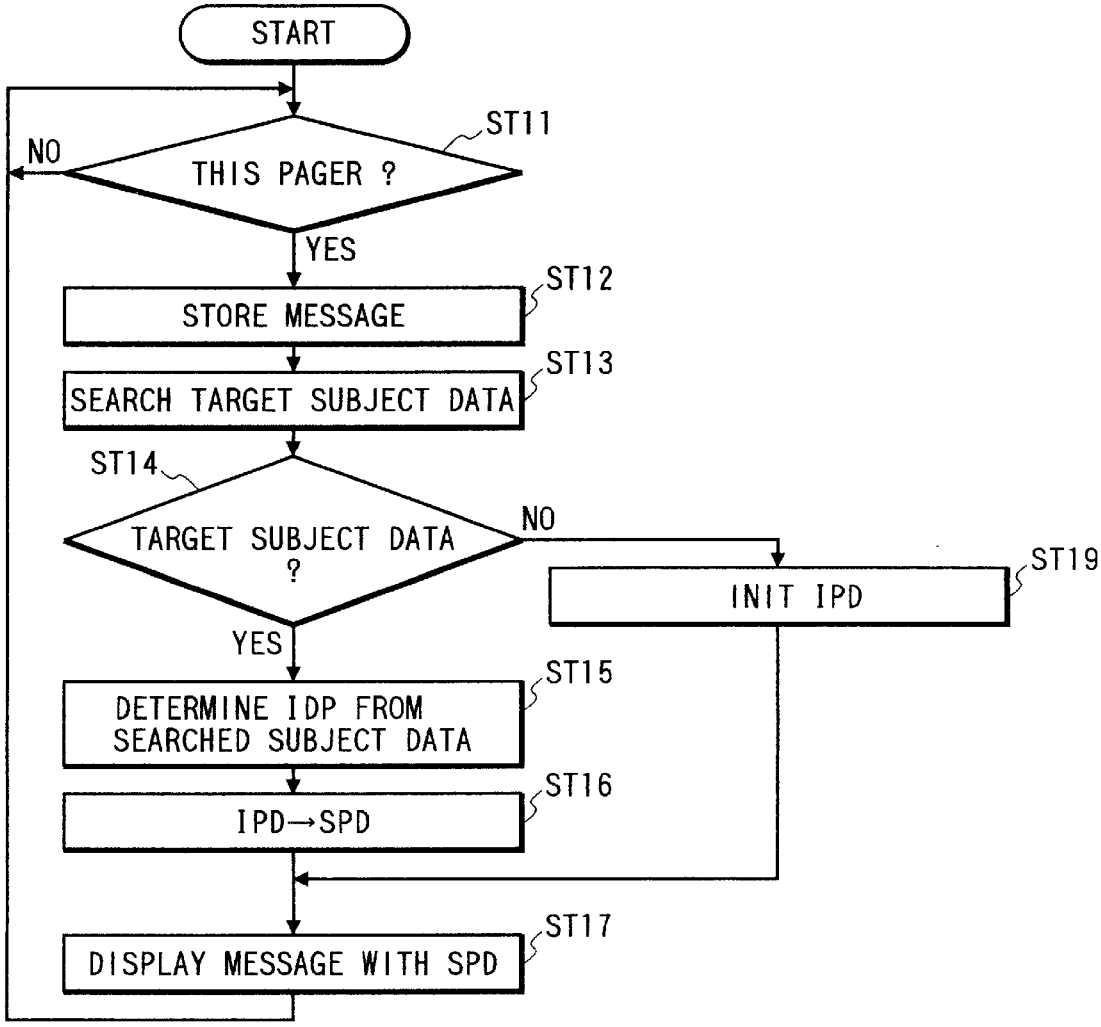
FIGS. 7 and 8 depict flow charts of the second embodiment showing showing operations of the microprocessor.
Figure 8:
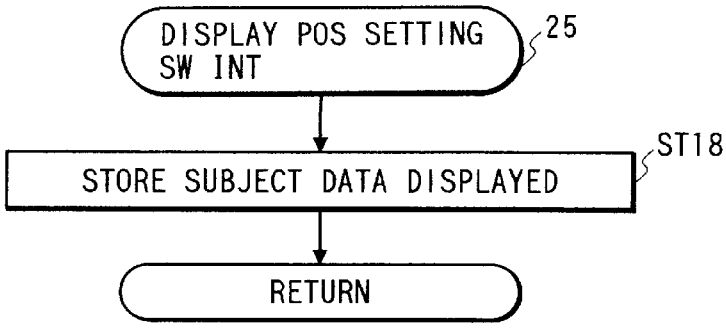

FIGS. 7 and 8 depict flow charts of the second embodiment showing operations of the microprocessor 3.

In step st11, the microprocessor 3 decides whether the paging signal is directed to this pager when the transmitted paging signal arrives. If the paging signal is directed to this pager, the microprocessor 3 stores the message in the second memory 5 in accordance with the channel defined by the identification code in the paging signal in step st12. In the following step st13, the microprocessor 3 searches the subject data 21 in the message, which corresponds to the target subject data 21 in the third memory 6 by collating the target subject data 21 stored in the third memory 6 with the subject data 21 in each sector of the message. The microprocessor 3 checks whether there is the target subject data 21 corresponding the subject data 21 in the third memory 6. If there is the subject data 21 corresponding the subject data 21, the microprocessor 3 determines the initial position data IPD from the searched subject data in the presently received message in step st16. If there is no subject data 21 corresponding to the target subject data, the microprocessor 3 changes or initializes the initial position data IPD and processing proceeds to step st17 to display the first screen image.

In step st16 following step st15, the microprocessor 3 substitutes the scroll position data SPD with the initial position data IPD in step st3, that is, the initial position data IPD is stored as the scroll position data SPD. The microprocessor 3 displays the message with the scroll position data SPD, that is, a portion of the message is displayed on the display 11 in accordance with the scroll position data SPD. More specifically, the microprocessor 3 generates the address data of the second memory 5 to display the portion of the message on the display 11. Then, the processing returns to step st11.

FIG. 7 depicts a flow chart of the second embodiment showing a display position setting switch interruption 25. In response the display position setting switch 8, the microprocessor 3 executes the display position setting switch interruption 25 during step st17. In step st18, the microprocessor 3 stores the displayed subject data 21 in the third memory 6 in step st18 and then, the processing returns.

Therefore, after operating the display position setting switch 8, the pager displays the portion of the next message including the subject data 21 corresponding the target subject data stored in the third memory 6 in response to the display position setting switch 8 through searching.

What is claimed is:

1. A pager comprising:

receiving means for receiving a transmitted paging signal including a calling signal and a message including a plurality of sectors, each sector including subject data and current data regarding said subject data;

a display for displaying said message for each said sectors;

first storing means responsive to said receiving means for storing said message when said calling signal indicates this pager;

second storing means responsive to a manual operation for storing said subject data included in one of said sectors;

collating means for collating said subject data in said second storing means with said subject data of each sector included in the next message when said receiving means receives the next transmitted paging signal and said calling signal indicates this pager, said collating means determining whether said subject data in said second storing means corresponds to said subject data of each sector included in the next message to provide a collating result; and displaying means for reading and displaying a portion of the next message including at least said one of said sectors in accordance with said collating result from said collating means.

2. The pager as claimed in claim 1, wherein said displaying means reads and displays said portion of the next message such that said portion of the next message includes said subject data corresponding to said subject data in said second storing means.

3. The pager as claimed in claim 1, further comprising:

displaying portion changing means for changing said portion of the next message to be displayed when said collating means cannot detect collation of said subject data of each sector with said subject data of each sector included in the next message when said receiving means receives the next transmitted paging signal and said calling signal indicates this pager.

* * * * *